US006158830A

United States Patent [19]

Johnson et al.

[11] Patent Number: 6,158,830

[45] Date of Patent: Dec. 12, 2000

[54] LOCK ASSEMBLY

[75] Inventors: Eric C. Johnson, Mountaintop; Jeffrey C. Olson, Dallas; Robert R. Steele, Sweet Valley; Bradley J. Carlson, Wilkes-Barre, all of Pa.

[73] Assignee: Metro Industries, Inc., Reno, Nev.

[21] Appl. No.: 09/164,633

[22] Filed: Oct. 1, 1998

[51] Int. Cl.[7] ..... E05B 65/46

[52] U.S. Cl. ..... 312/218; 312/219

[58] Field of Search ..... 312/217, 218, 312/219, 216, 222, 215, 221, 333, 265.1, 265.4; 70/78, 79; 292/8, 26, 30, 158

[56] References Cited

U.S. PATENT DOCUMENTS

| | | | |
|---|---|---|---|
| 2,309,863 | 2/1943 | North | 312/219 X |
| 4,616,890 | 10/1986 | Romick | 312/216 X |
| 5,503,440 | 4/1996 | Peccoux | 312/218 X |
| 5,647,650 | 7/1997 | Daugherty et al. . | |
| 5,802,892 | 9/1998 | Cohn et al. | 70/84 |

FOREIGN PATENT DOCUMENTS

| | | | |
|---|---|---|---|
| 98505 | 4/1923 | Switzerland | 312/219 |

*Primary Examiner*—Janet M. Wilkens
*Attorney, Agent, or Firm*—Fitzpatrick, Cella, Harper & Scinto

[57] ABSTRACT

A lock assembly for use in an enclosed structure housing a locking bar having a plurality of locking fingers includes a lock arm mechanism having a lock arm and a lock arm mounting assembly for mounting the lock arm mechanism in the enclosed structure. The lock arm causes a rigid finger on the locking bar to be raised and lowered and in doing so raises and lowers the locking bar.

26 Claims, 15 Drawing Sheets

LOCK ASSEMBLY

BACKGROUND OF THE INVENTION

1. Field of the Invention

The present invention relates generally to a security system for securing an enclosed structure, and more particularly to a lock assembly forming part of the security system.

A security system with a distinctly different type of lock assembly and an enclosed structure, such as a cabinet or a cart, in which the security system can be incorporated are disclosed in commonly assigned U.S. Pat. No. 5,647,650, which is incorporated herein by reference.

The lock assembly of the present invention is ideally situated for use in an enclosed structure and security system as shown in FIG. 1. In that figure, an enclosed structure 10 includes four flanged support posts 12 for supporting two exterior side panels 14 and an unshown back panel. Interior side panels 16 are disposed side-by-side adjacent to the exterior side panels. Top and bottom platforms 18 and 20, respectively, complete the basic components of the enclosed structure. The completed structure forms a 3-sided enclosed frame, with the front side, or fourth side, open to slidably receive an array of drawers, shelves, etc.

Each interior side panel 16 includes a corrugated interior surface 21 with an array of corrugations 23 adapted to receive the drawers, shelves, etc. The horizontal corrugations are uniformly spaced in the vertical direction. Small, semicircular openings 25 can be seen in the lateral front face of the interior side panel immediately below the end of each corrugation. The openings extend to the underside of each corrugation but cannot be seen in this view. The openings allow locking fingers, which will be positioned in the corrugations as discussed below, to move in and out of the corrugations as part of the security system.

A main component of the security system of the '650 patent is an elongated locking bar 22 as shown in FIG. 2. The locking bar is equipped with a plurality of flexible locking fingers 24, or locking members, secured along its length. The locking bar 22 is positioned in an elongated recessed pocket 27 in the interior side panel 16 as shown in FIG. 3. When the locking bar is in position, each locking finger will be located in a corrugation of the interior side panel.

With reference to FIG. 4, each locking finger includes a lateral arm 26 and an angular tip 28. The angular tip 28 is formed to have an angled face 32 spanning an abutting face 34 and a front face 36. As seen in the figure, the lateral arm is angled and extends from a base plate 29, which is affixed to the locking bar.

A partial front view of the corrugated side panel 16 with two locking fingers 24 is shown in FIG. 5. In this figure, the locking fingers 24 extend through the openings 25 in the underside of the corrugations 23, and are thus in their locked position. In the locked position, the locking fingers will engage a notched channel or other corresponding element in a sliding frame of a drawer, tray, door, etc., and prevent it from being withdrawn. In this locked position, however, the shape and flexibility of the locking finger allows for an open drawer to be fully inserted and locked. More specifically, the angled face of the finger tip permits the sliding frame to impart an upward force to the locking finger, which in response will flex upwardly and allow the drawer to continue sliding until the notched channel receives the finger tip. At this point the locking finger will return to its unbiased state and lock the drawer.

2. Description of the Prior Art

In the security system disclosed in the '650 patent, the enclosed structure is secured (locked) and unsecured (unlocked) by directly engaging the locking bar. Lifting the locking bar raises the locking fingers out of the openings and unlocks the enclosed structure. In one embodiment, a cam 31 engages the locking bar from below as shown in FIG. 3. The cam is rotated by an electric motor 33 to raise and lower the locking bar. In another embodiment, a mechanical locking mechanism employs an S-shaped link that is connected to a top portion of the locking bar. A pin operated by a key lock engages and rotates the link to raise and lower the locking bar.

However, further improvements in a security system for an enclosed structure are desired. For example, it is desirable to provide a lock assembly with increased versatility and mobility, allowing it to be positioned at any desired height position in the enclosed structure and easily added or removed therefrom.

SUMMARY OF THE INVENTION

It is a principal object of the invention to provide a lock assembly for use with an enclosed structure.

It is an object of the invention to provide a lock assembly with superior versatility and ease of operation.

It is a further object of the invention to provide a lock mechanism that readily can be located at different height positions in the enclosed structure.

In accordance with one aspect of the invention, a lock assembly is provided for use in an enclosed structure housing a lock bar having a plurality of fingers secured thereto. The lock assembly comprises a lock arm mechanism including a lock arm, and a lock arm mounting assembly for mounting the lock arm mechanism in the enclosed structure. The lock arm causes a rigid finger on the lock bar to be raised and in so doing raises the lock bar.

In another aspect of the invention a locking structure is formed of an enclosed structure including first and second sides having interior corrugated surfaces, and a lock bar having a plurality of flexible fingers, with the lock bar housed in the first side such that the fingers extend out of openings in the corrugated surface. A stabilizer is provided on the lock bar for rendering a designated one of the fingers inflexible, and locking means engages the designated finger to raise and lower the lock bar.

In another aspect of the invention, the locking means includes a pivotable lock arm and an actuator extending from a first end of the lock arm for engaging the designated finger.

In yet another aspect of the invention, a lock assembly for use with a lock bar having a plurality of flexible fingers includes stiffening means for rendering a designated finger substantially inflexible, and lock means for engaging the designated finger to raise and lower the lock bar.

In another aspect of the invention, a locking structure comprises an enclosed structure including a plurality of flanged support posts and first and second sides having interior corrugated surfaces, and a locking bar having at least one locking member. The locking structure also includes a lock arm mechanism including means for raising the locking bar, a lock arm mounting assembly mounting the lock arm mechanism, and modular mounting means for mounting the lock arm mounting assembly to the flanged support posts.

In still another aspect of the invention, a modular lock assembly for use in an enclosed structure housing a locking bar having at least one locking member includes a lock arm mechanism including an actuable lock arm, and a lock arm mounting assembly for mounting the lock arm mechanism in the enclosed structure. In addition, modular mounting means secures the lock arm mounting assembly to the enclosed structure, and locking means locks the enclosed structure when the lock arm is actuated.

These and other objects, aspects, features and advantages of the present invention will become apparent from the following detailed description of the preferred embodiments taken in conjunction with the accompanying drawings.

DESCRIPTION OF THE PREFERRED EMBODIMENTS

Figure 1:
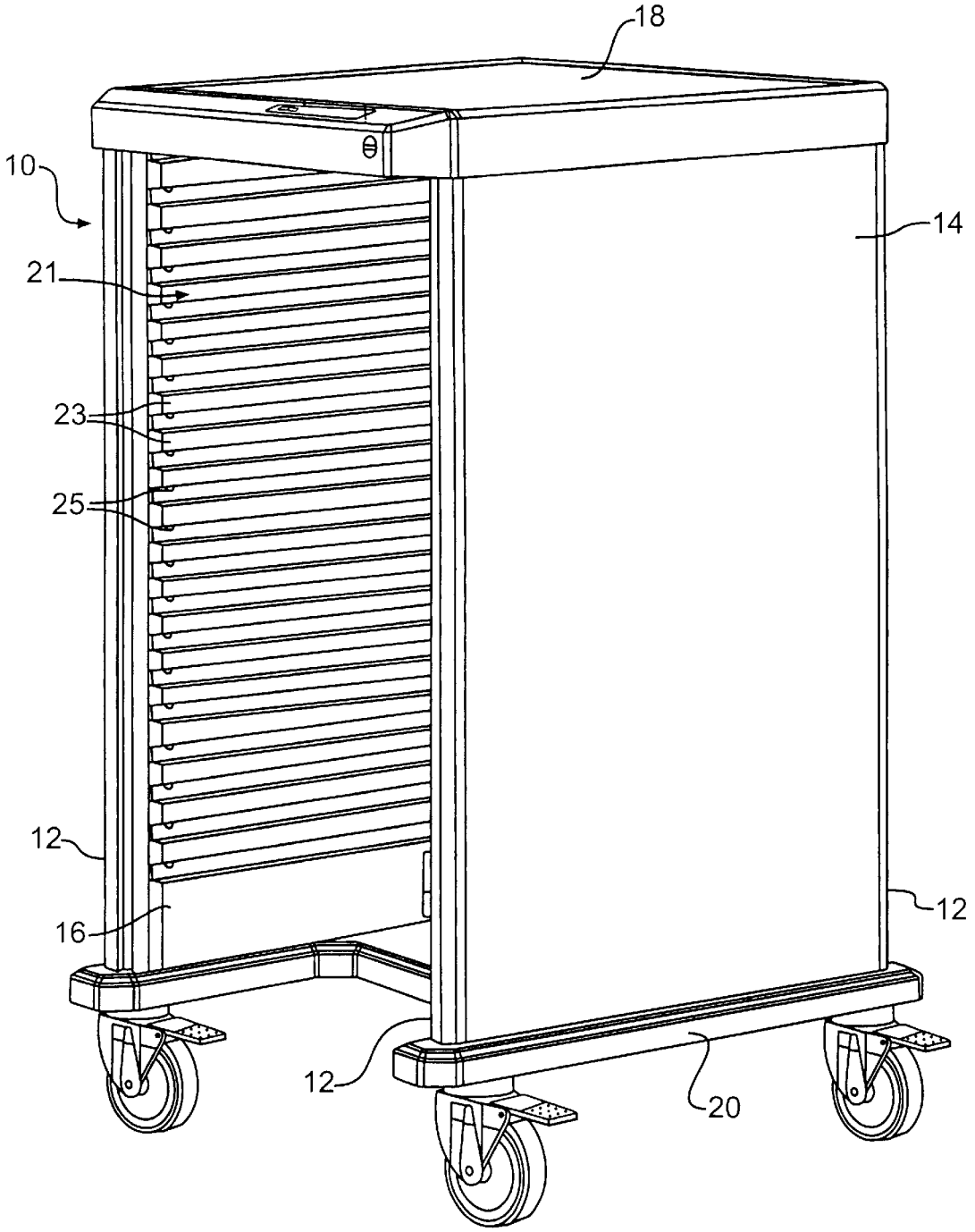
FIG. 1 PRIOR ART
FIG. 1 is a perspective view of a conventional enclosed structure.
Figure 2:
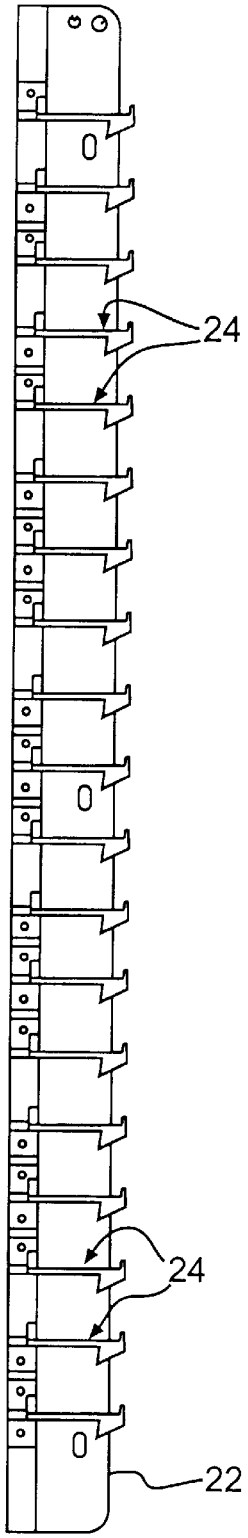
FIG. 2 PRIOR ART
FIG. 2 is a side elevational view of a conventional locking bar equipped with locking fingers.
Figure 3:
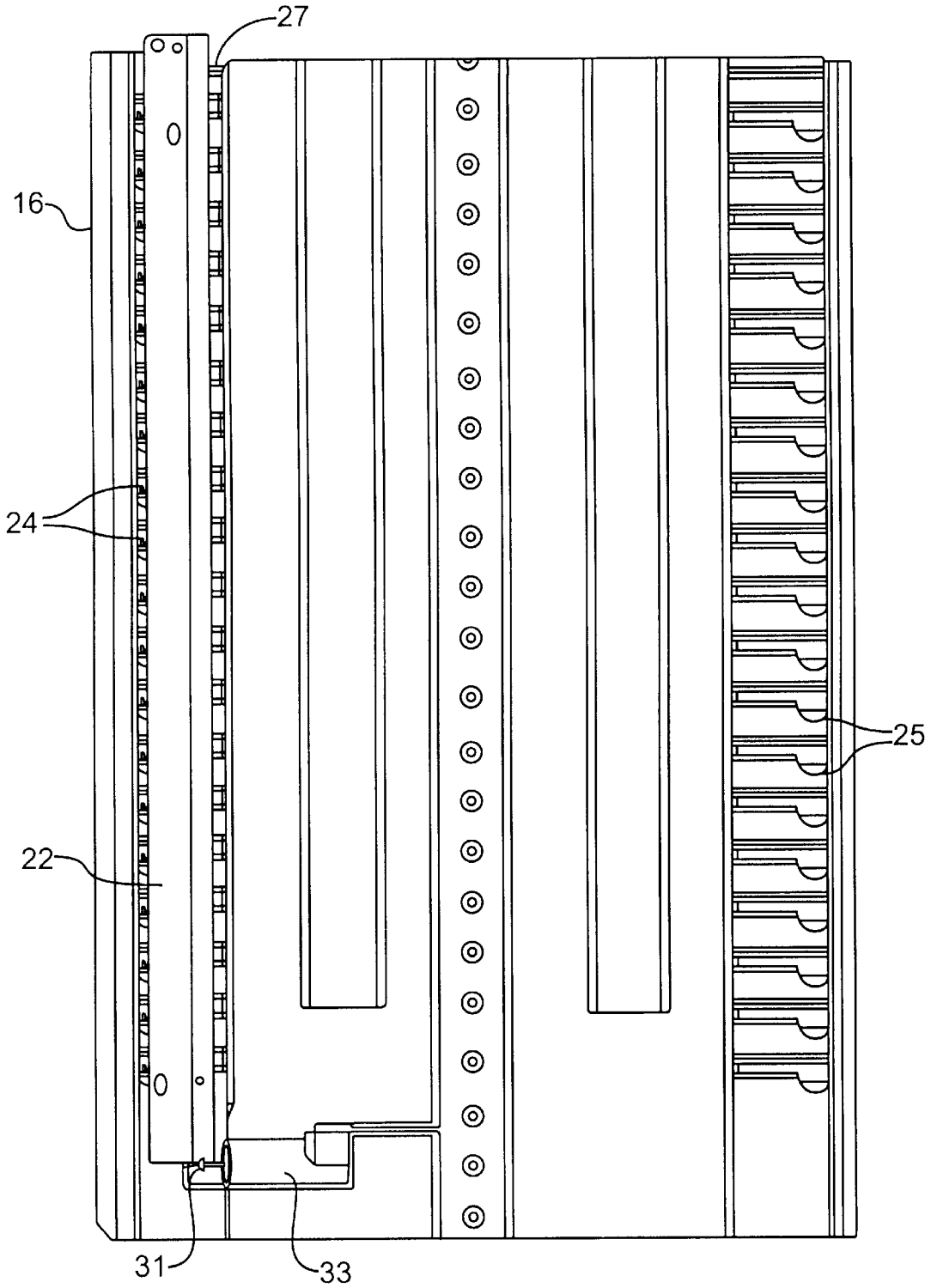
FIG. 3 PRIOR ART
FIG. 3 is a side elevational view of the conventional locking bar positioned in a corrugated side panel.
Figure 4:
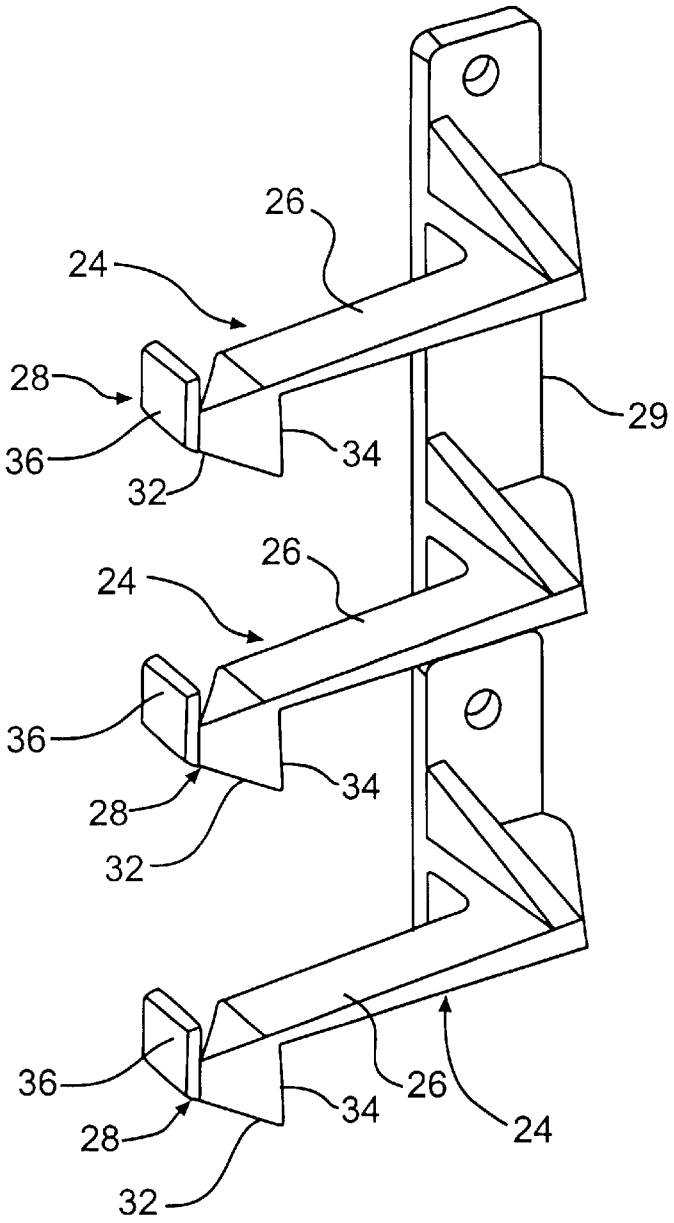
FIG. 4 PRIOR ART
FIG. 4 is a perspective view of conventional locking fingers.
Figure 5:
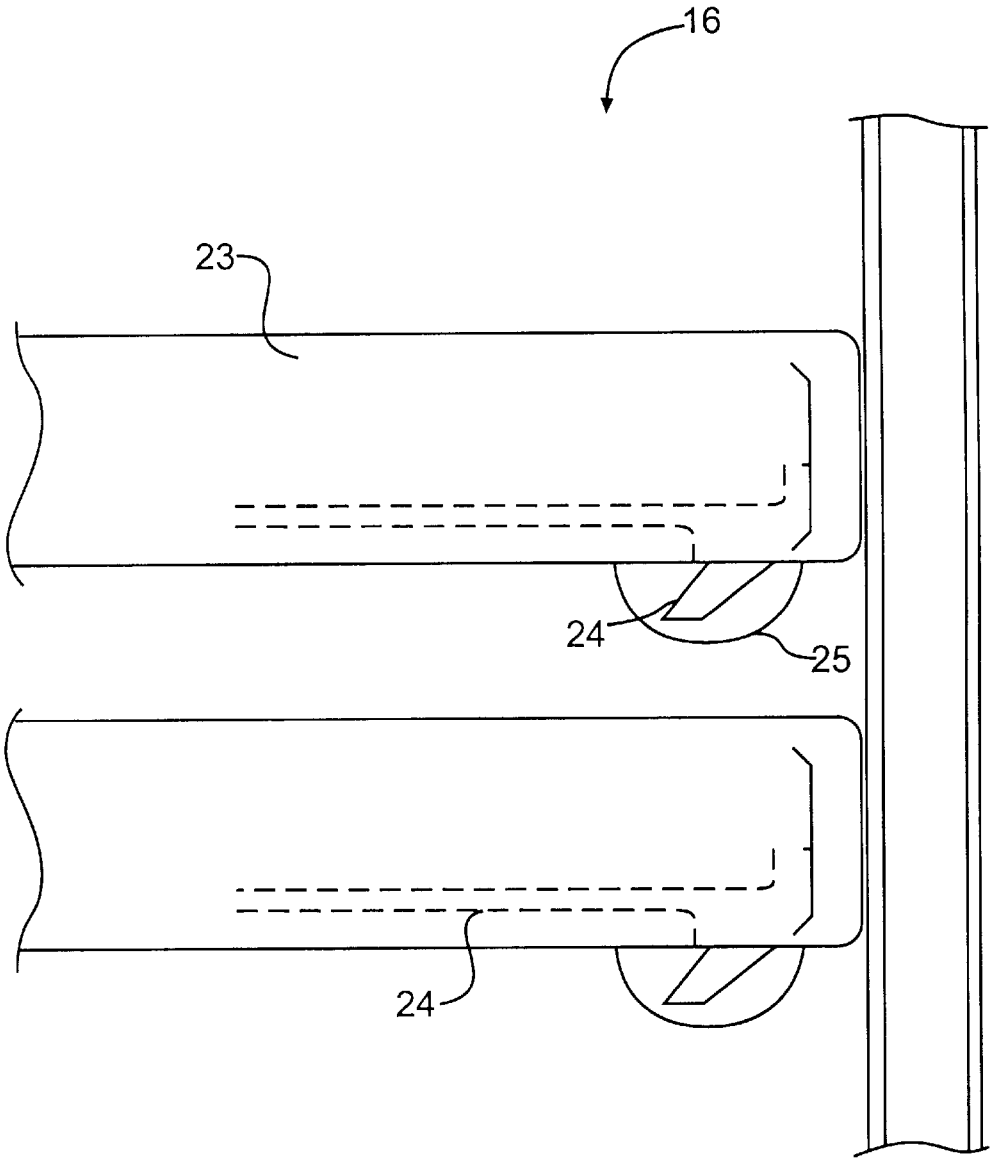
FIG. 5 PRIOR ART
FIG. 5 is a partial side elevational view of the conventional locking bar in a corrugated side panel.
Figure 6:
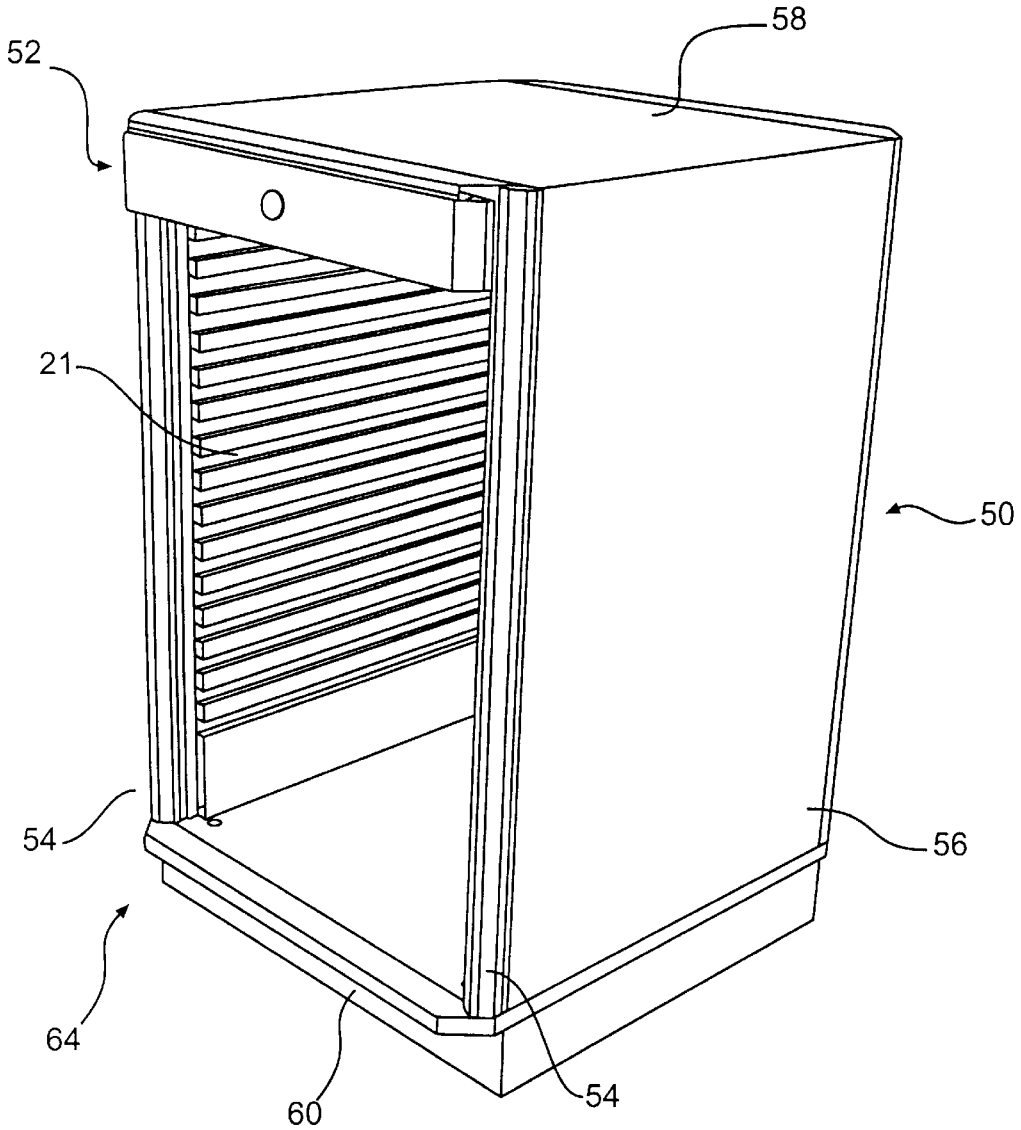
FIG. 6 is a perspective view of a cabinet equipped with a top-mounted lock assembly in accordance with the present invention.
Figure 7:
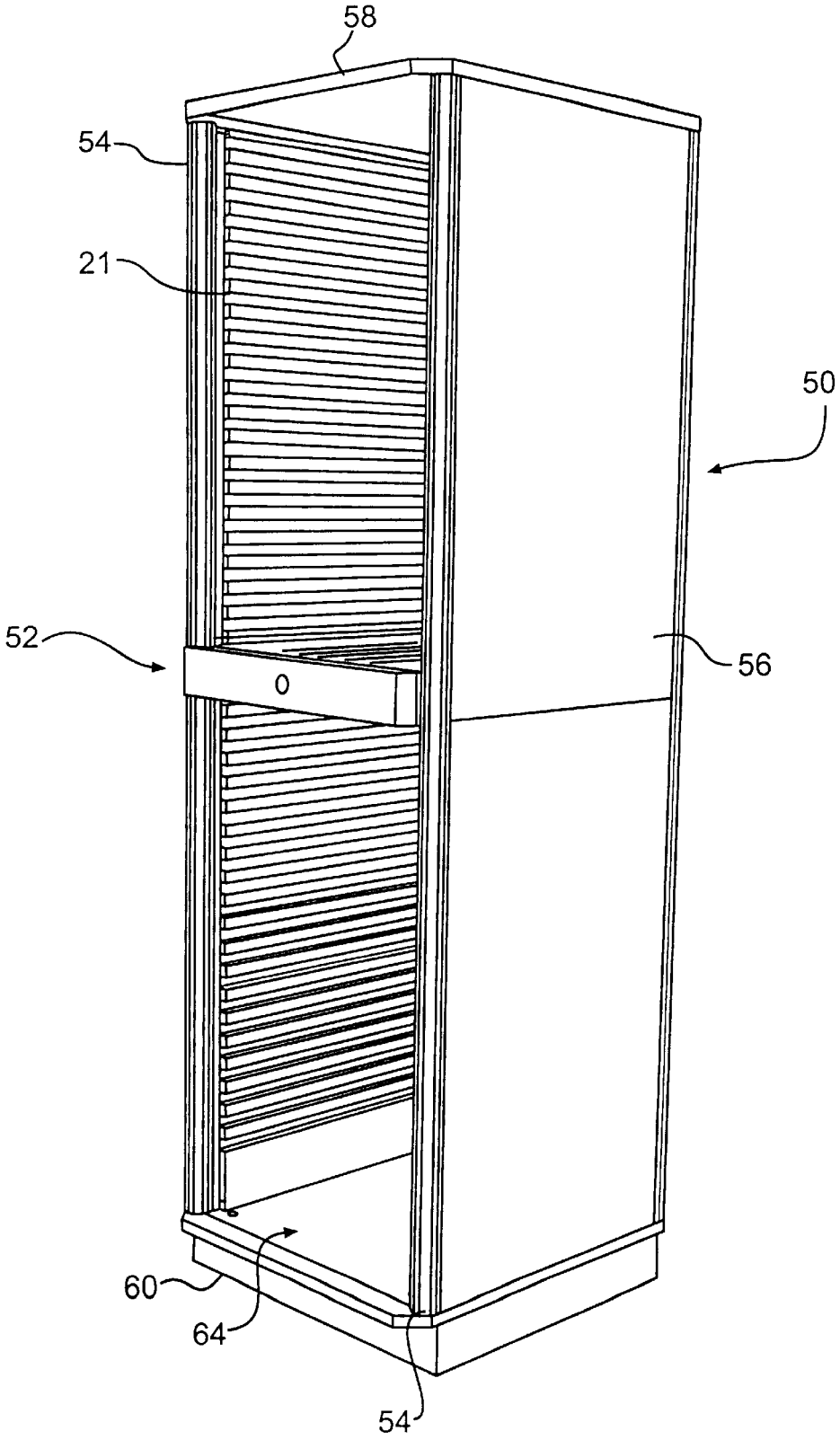
FIG. 7 is a perspective view of a cabinet equipped with a mid-level lock assembly in accordance with the present invention.

FIGS. 6 and 7 illustrate two preferred embodiments of the invention, with both showing a modular enclosed structure, e.g., a cabinet 50, provided with a lock assembly 52 of the present invention. In FIG. 6 the lock assembly is positioned at the uppermost portion of the cabinet 50 and thus is considered to be a "top-mounted" lock assembly. The lock assembly 52 in FIG. 7 is a "mid-level" lock assembly, as it is mounted below the uppermost portion. As will be appreciated from the detailed discussion below, one of the benefits of the lock assembly of the present invention is that it can be positioned at any desired location along the entire height of the enclosed structure and in this sense is itself modular.

By way of background information, the cabinet 50 itself in this non-limiting example utilizes a platform system comprised of flanged posts 54 at each corner for receiving at least first and second side panels 56, a top assembly 58 and a bottom assembly 60. An unshown back panel would also normally be provided, although the back could be left open to slidably receive items. As discussed above, panels with corrugated interior surfaces 21 are provided opposite to both the first and second side panels for slidably receiving a drawer, shelf, door frame, etc. in the front opening 64 and, if desired, in the back opening.

In accordance with one aspect of the present invention, a locking bar, which is preferably housed in a recessed pocket of the corrugated panel, is raised and lowered by engaging and lifting a designated locking finger on the locking bar. By causing a normally flexible finger to become substantially rigid as discussed below, raising and lowering that finger causes the locking bar to also be raised and lowered. This feature will be further explained with reference to FIGS. 8 and 9.

Figure 8:
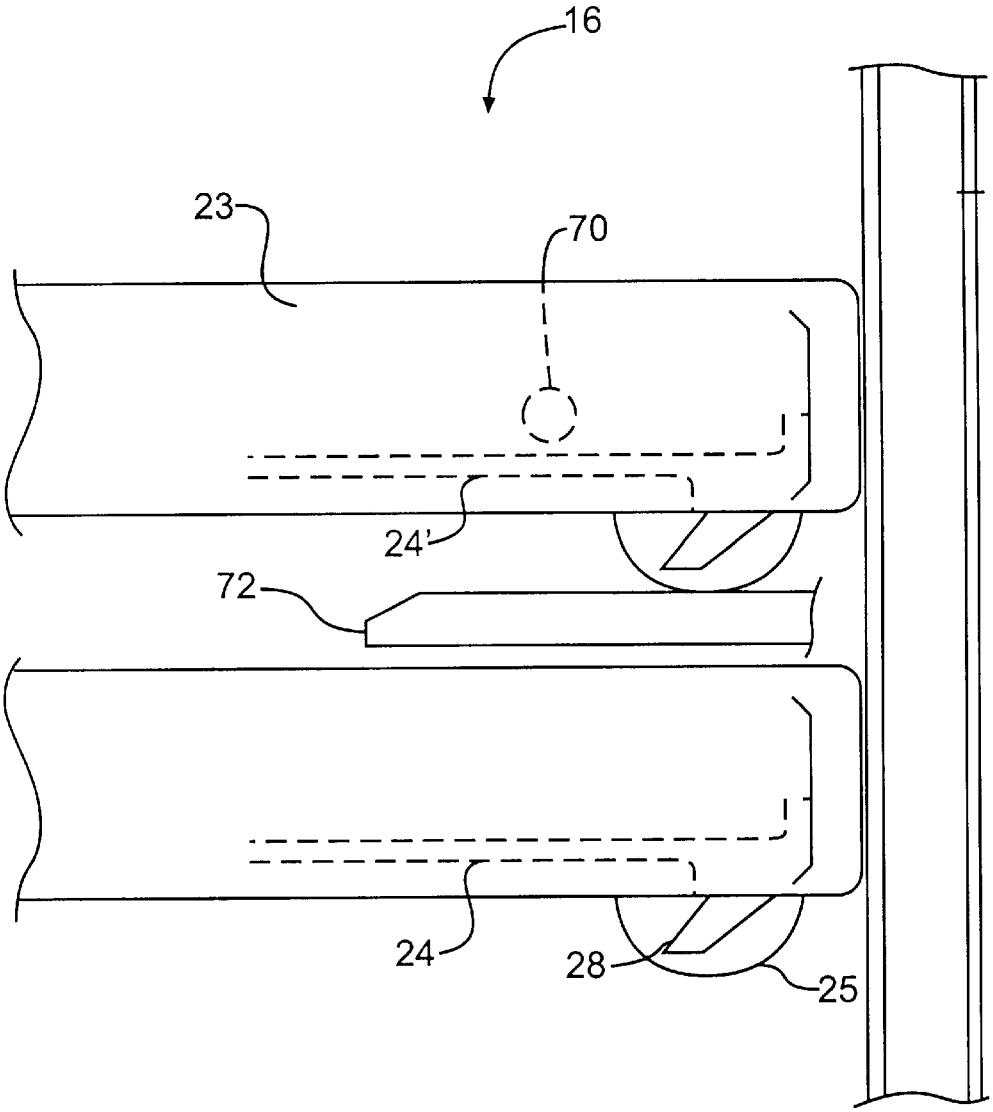
FIG. 8 is a partial side elevational view of a locking bar of the present invention located in a corrugated side panel in the locked position.

FIG. 8 shows an interior side panel 16 with two locking fingers 24 in their "down" (i.e., locked) position in which the finger tips 28 extend through the openings 25 in the corrugations 23.

Figure 10:
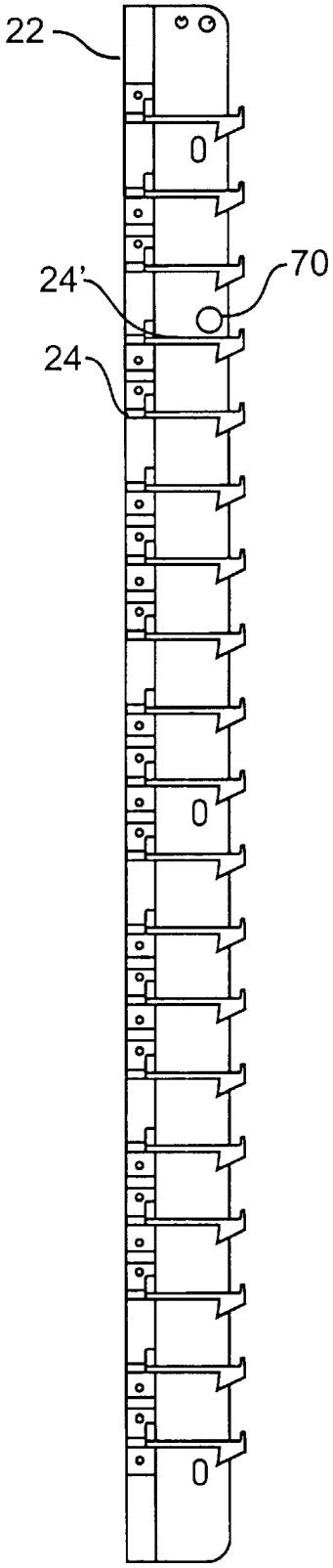
FIG. 10 is a side elevational view of the locking bar of the present invention.

In accordance with the present invention, a stabilizer 70, such as a pin or screw, is located directly above one of the fingers and secured to the locking bar. In this way, the flexibility of that designated finger 24' is effectively removed and it becomes substantially rigid. Thus, when the designated finger is lifted, the locking bar will also be raised. The stabilizer 70 positioned on the locking bar 22 can also be seen in FIG. 10. If a pin is used, it can be fixed directly to the locking bar (e.g., welded) or inserted and secured in an opening in the locking bar. Of course, the stabilizer can be located at any desired position on the locking bar.

As will be appreciated, alternative means for stabilizing, or stiffening, a flexible finger on the locking bar can be used without departing from the scope of the invention. This could include, as a non-limiting example, replacing the flexible finger altogether with a rigid finger.

Figure 9:
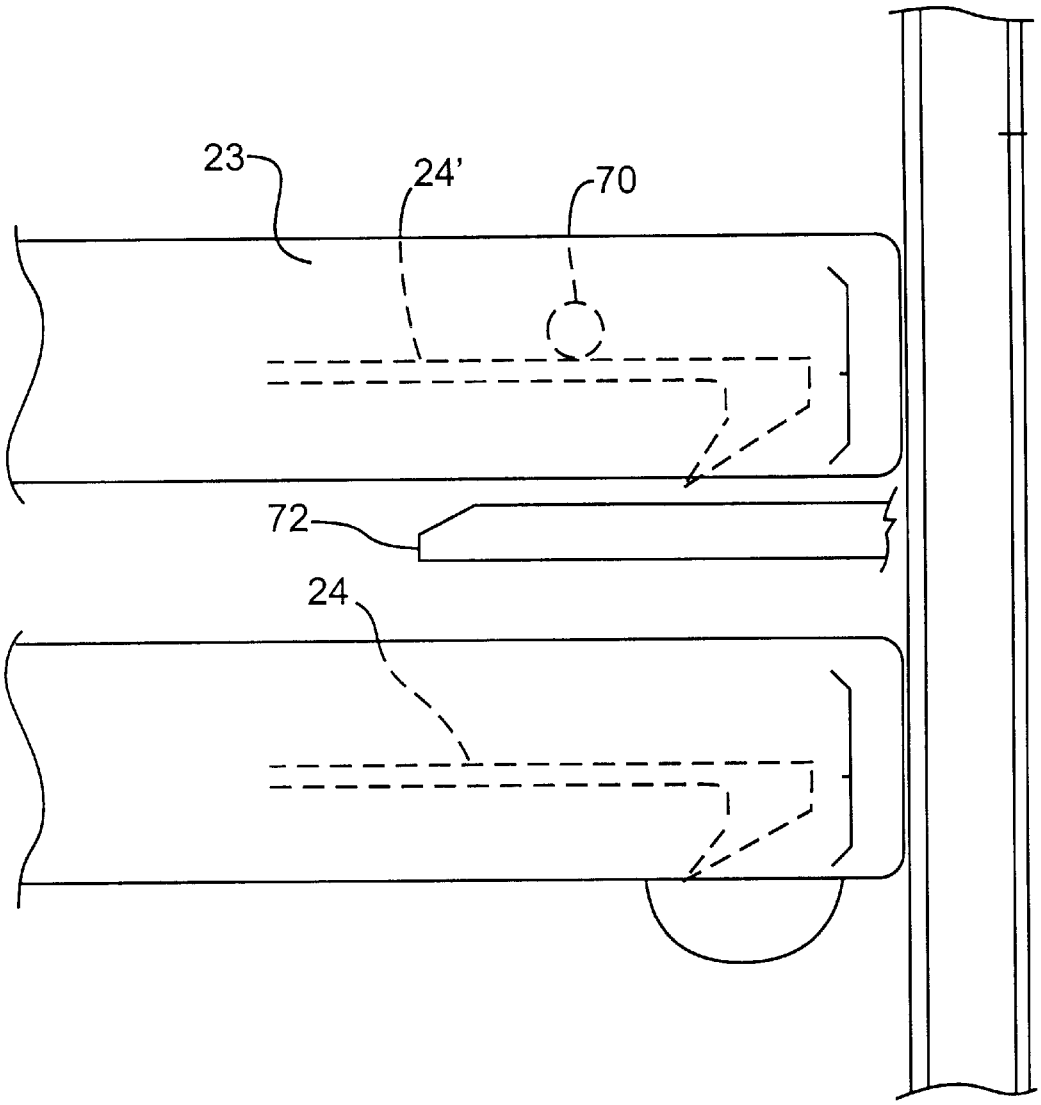
FIG. 9 is a partial side elevational view of a locking bar of present invention located in a corrugated side panel in the unlocked position.

FIG. 9 shows the designated finger 24' being engaged and lifted by a rod 72, or actuator, of a locking assembly that will be described below in detail. Since the designated finger cannot flex upwardly, lifting it also raises the locking bar and with it the other locking fingers. The fingers in FIG. 9 are thus located in their open, or unlocked, position.

Figure 11:
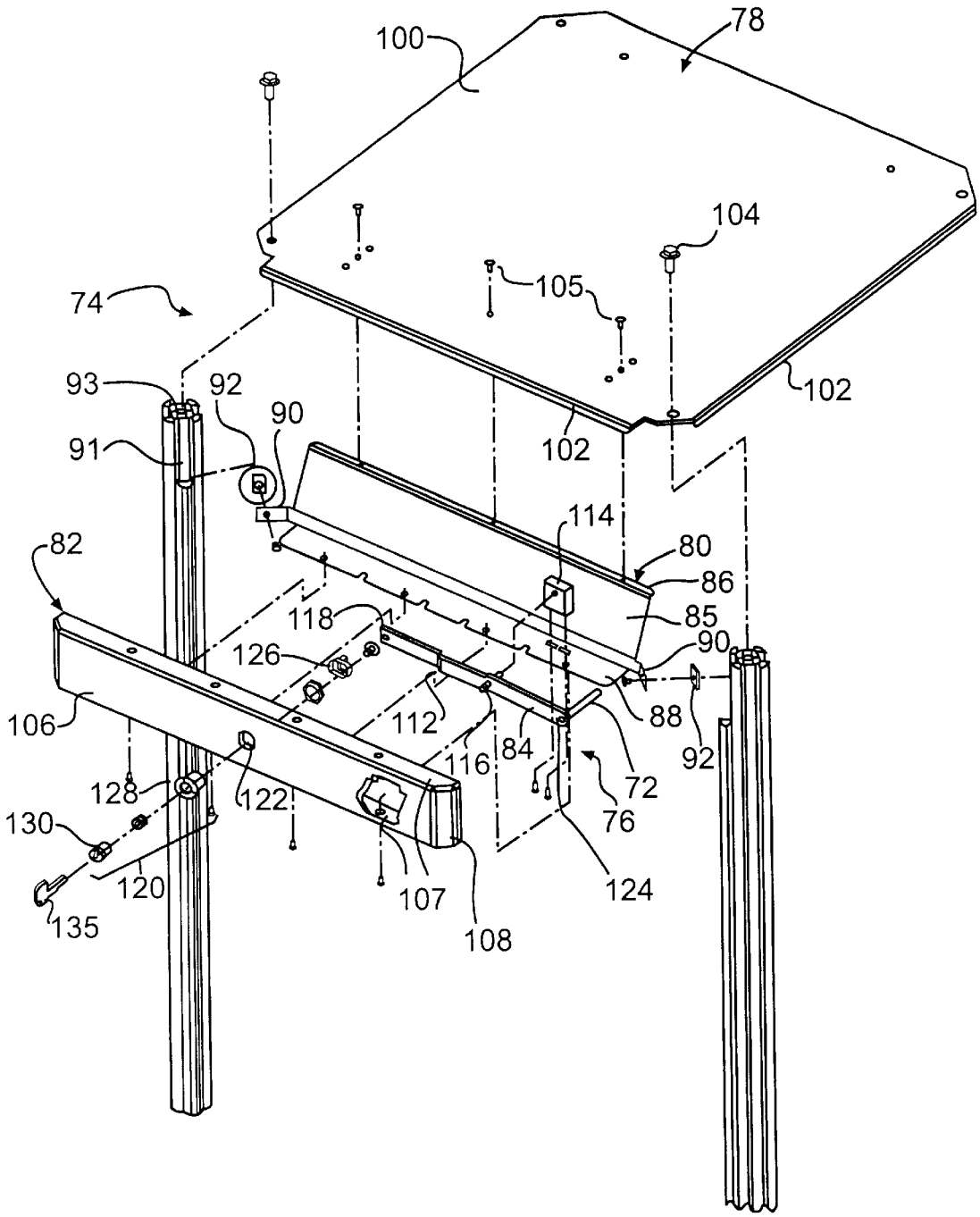
FIG. 11 is an exploded view of the top-mounted lock assembly of the present invention.

FIG. 11 is an exploded view of a lock arm mounting assembly 74 and a lock arm mechanism 76 in the top-mounted lock assembly of the present invention. The main components of the mounting assembly are a top frame 78, a lock module bracket 80 and a lock face 82. These components are interconnected together, for example, by screws or rivets, and house therein a lock arm 84 of the lock arm mechanism.

Figure 12:
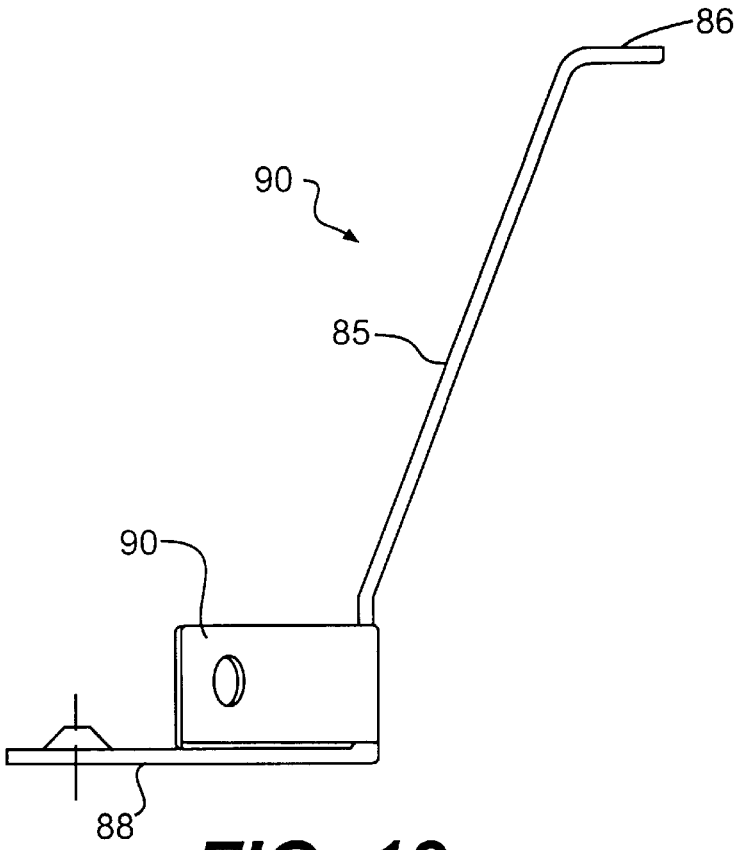
FIG. 12 ia side elevational view of a lock module bracket of the top-mounted lock assembly of the present invention.

As seen in the perspective view of FIG. 11 and in the side elevational view of FIG. 12, the lock module bracket 80 can be formed of a single piece, e.g., of sheet metal, and shaped to have an inclined face 85, a top ledge 86 to be connected to the top frame, and a lower flange 88 for connecting to the lock face. The lock module bracket also includes angled tabs 90 to be secured to the flanged support posts 54 by a self-locking cam nut 92.

Figure 13:
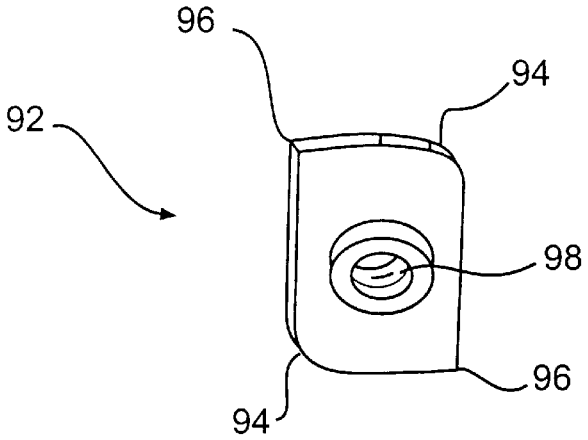
FIG. 13 is a perspective view of a cam nut of the present invention.

As shown in FIG. 13, the rectangularly-shaped cam nut 92 has alternating round 94 and square 96 shoulders and an internally threaded opening 98 for receiving a screw.

To secure the lock module bracket 80 to the support posts, a screw is fed through the angled tab 90 and received in the cam nut, which is then positioned within a slot 91 formed between an adjacent pair of flanges. Alteratively, the cam nut can be prepositioned within the slot before receiving the screw. As the screw is turned, the cam nut will initially rotate ¼ turn (i.e., 90°) in the clockwise direction until its length becomes perpendicular to the length of the slot. At this point the square shoulders 96 will contact the interior surfaces of the slot and prevent further rotation of the cam nut. Continued tightening of the screw will secure the lock module bracket to the support posts. As will be appreciated, alternative means of securing the lock module bracket to the support posts can be used without departing from the scope of the invention.

The top frame 78, which can also be made of sheet metal, includes a flat surface 100 with downturned edges 102 as shown in FIG. 11. The top frame is secured to threaded cores 93 in the flanged posts by, for example, screws or bolts 104 and to the lock module bracket 80 by, for example, rivets or screws 105.

The lock face 82 has a front face 106, upper and lower edges 107 and beveled sides 108, and is preferably formed of a plastic material. The lower edge 107 of the lock face is secured to the lower flange 88 the lock module bracket 80 by, for example, rivets or screws.

Figure 18:
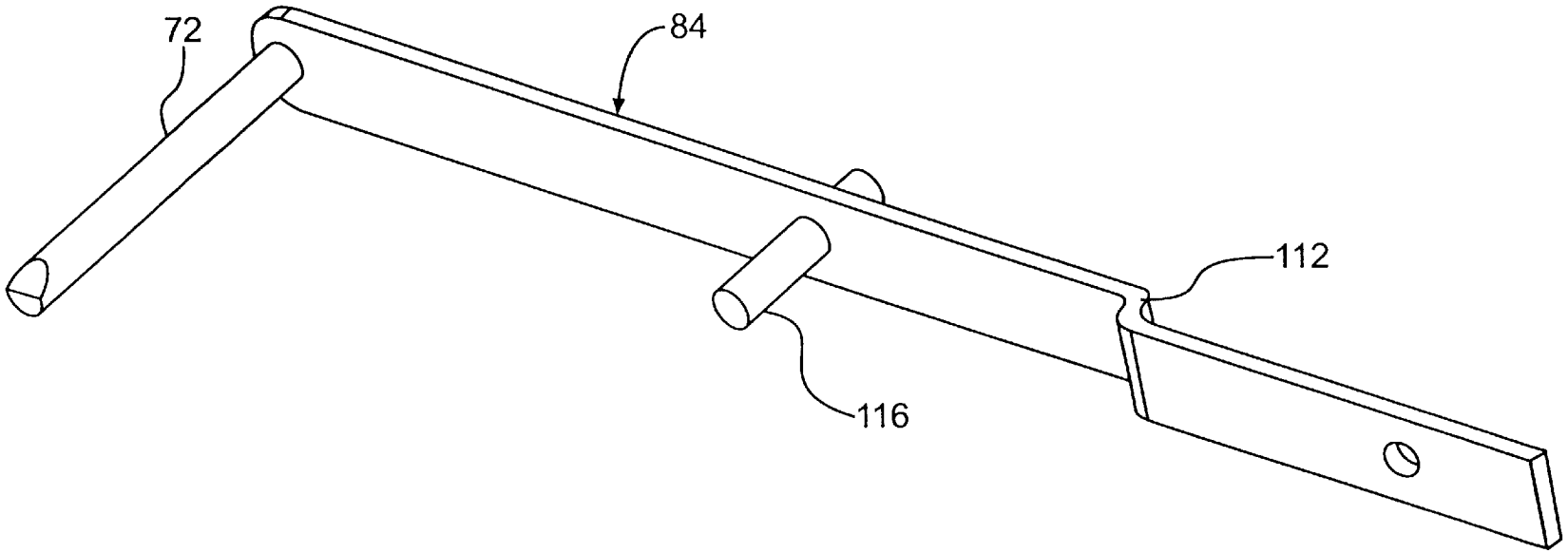
FIG. 18 is a perspective view of a lock arm mechanism of the present invention.

The lock arm mechanism 76 is shown in FIGS. 11 and 18 to include an elongated lock arm 84 that includes an offset portion 112 and is pivotally mounted to a bearing block 114 by a pin 116. The arm can be made of, for example, a plated metal. The bearing block is preferably secured to the lower flange 88 of the lock module bracket 80. An operating end 118 of the lock arm is connected to locking hardware 120, which is secured to the lock face 82 through an opening 122 therein. An actuating end 124 of the lock arm has a pin or rod 72 extending substantially perpendicular thereto for engaging the designated locking finger as discussed above. As best seen in FIGS. 8 and 9, the rod 72 is positioned in a corrugation of the corrugated side panel directly below the designated locking finger.

Figure 14:
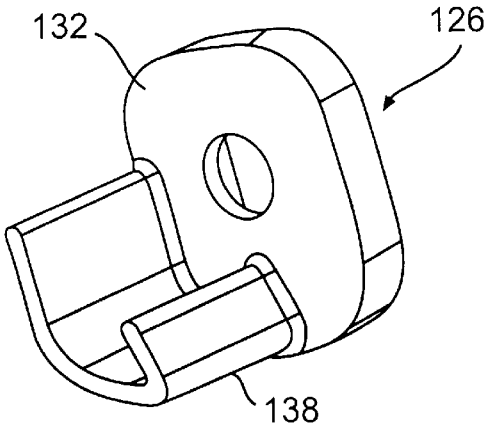
FIGS. 14 and 15 are perspective views of a front and back, respectively, of a lock cam of the present invention.
Figure 15:
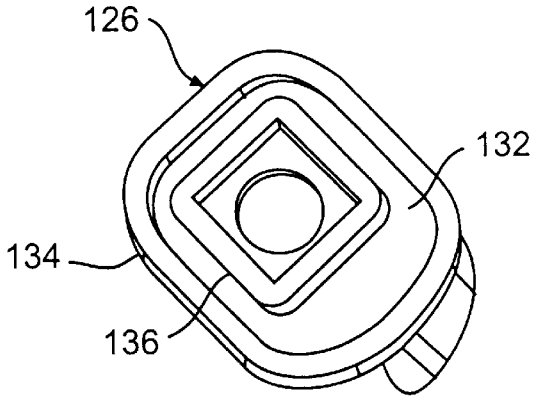
Figure 16:
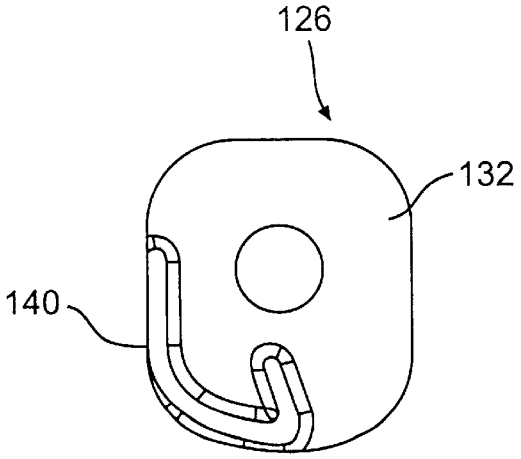
FIG. 16 is a side elevational view of the front of the lock cam of the present invention.

The locking hardware includes a lock cam 126 for actuating the operating end 118 of the lock arm and also a lock housing 128 and lock core 130. The lock cam 126 is best seen in FIGS. 14 and 15 to include a base 132 having on its back surface a rim 134 and a raised frame 136. The front surface of the base has a cam guide 138 for contacting the lock arm. With reference to FIG. 16, the cam guide 138 has a minimal taper 140 on its outer edge. Operation of the lock mechanism, by turning a key 135, rotates the lock cam and serves to pivot the lock arm 84 about the pin 116. The pivoting lock arm moves the rod 72 up and down within the confines of the corrugation.

As best seen in FIGS. 8 and 9, the lock arm is positioned to place the rod 72 directly below the designated locking finger 24', while the stabilizer 70 is placed directly above the locking finger. In this manner, when the lock arm is rotated in the counterclockwise direction, the rod will be lifted and in so doing will engage and raise the locking finger. The stabilizer prevents the locking finger from flexing, and therefore the upward force on the locking finger raises the entire locking bar, thus lifting all the locking fingers. When the lock arm pivots in the opposite direction, i.e., clockwise, the rod is lowered, allowing the designated locking finger and locking bar to also be lowered. The locking bar can be lowered solely by gravity and, if desired, by an additional biasing force such as a spring.

Figure 17:
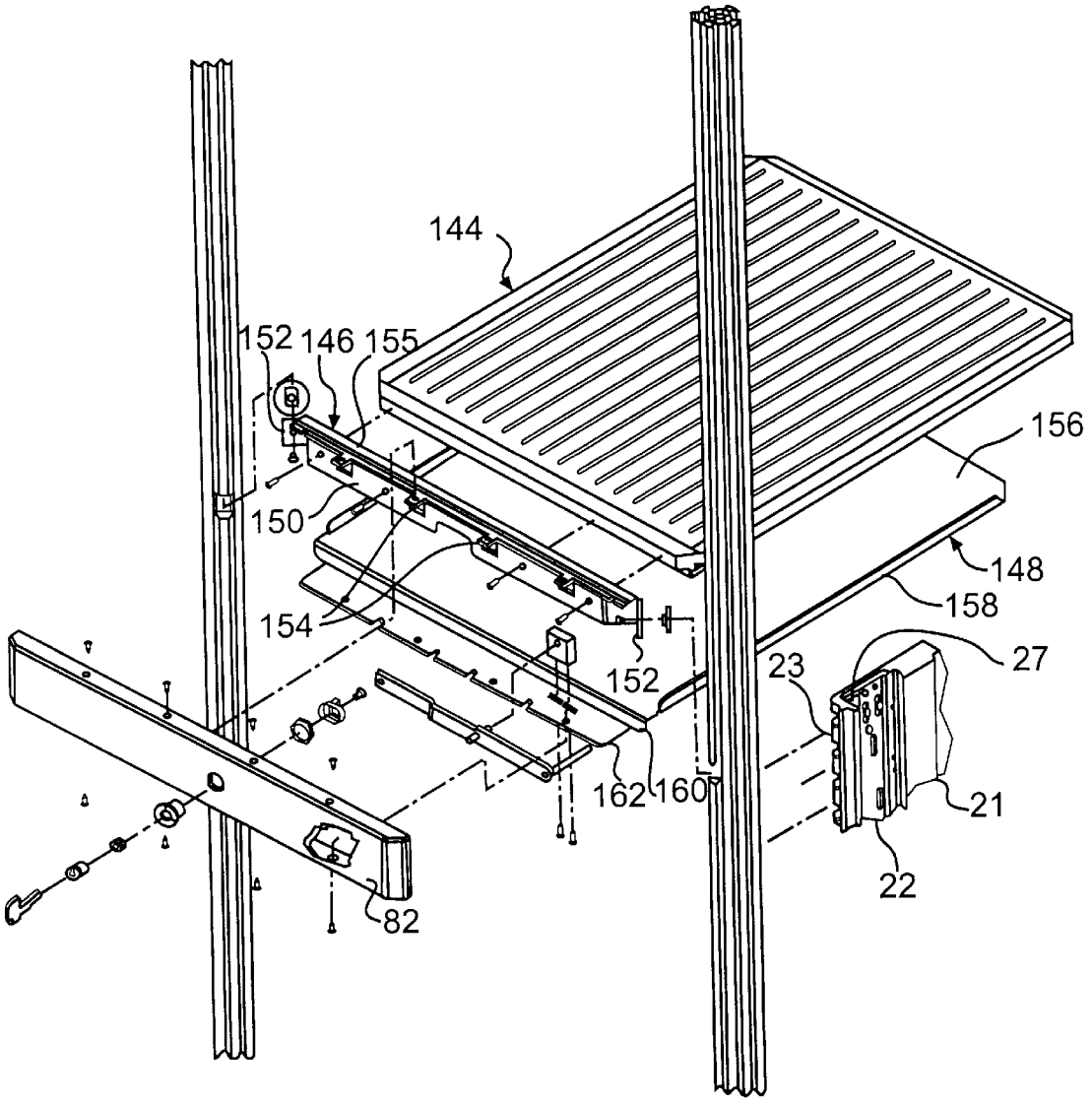
FIG. 17 is an exploded view of the mid-level lock assembly of the present invention.

The mid-level lock assembly is shown in FIG. 17. Since the mid-level lock assembly includes many of the same components as the top-mounted lock assembly, it will not be necessary to describe these common components in detail. The differences in this embodiment are embodied in a shelf 144, a modified lock module bracket 146 and a lock module tray 148. The lock module bracket and lock module tray are ideally formed out of sheet metal, while the shelf is preferably molded from plastic material.

The bracket 146 is shaped to have a front face 150 with double-angled side tabs 152 on either end and front tabs 154 extending from the front face. As in the first embodiment, the lock module bracket is preferably secured to the flanged support posts by cam nuts 92 secured to the side tabs. The front tabs are for securing the bracket to the lock face 82 by, for example, screws or rivets, and the front face 150 is fixed to the shelf 144 by screws or rivets as well.

The top of the bracket has a stepped horizontal surface 155.

The lock module tray 148 has a flat surface 156 with upturned lateral edges 158 and a downturned front edge 160. Extending from the front edge 160 is a lower flange 162. As in the first embodiment, the lower flange is secured to a bottom surface of the lock face 82 and also receives the bearing block for rotatably supporting the lock arm. The lock arm mechanism housed in the lock arm mounting assembly is identical to that described above in the first embodiment. The tray and shelf can be supported laterally by the corrugated interior surfaces.

In accordance with the present invention, the locking bar is raised and lowered by a modular lock assembly that can be provided at different heights, as desired, in the enclosed structure. In the first and second embodiments disclosed above, the lock assembly engages and raises a rigid finger (or locking member) on the locking bar to effect locking. It will be appreciated, however, that alternative means for raising and lowering the locking bar by the modular lock assembly can be provided without departing from the scope of the invention. For example, the lock arm mechanism can engage the locking bar directly or a rigid member (besides a locking finger) secured or connected to the locking bar.

Although specific embodiments of the present invention have been described above in detail, it will be understood that this description is merely for purposes of illustration. Various modifications of and equivalent structures corresponding to the disclosed aspects of the preferred embodiments in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A lock assembly for use in an enclosed structure housing a locking bar having a plurality of fingers secured thereto, the assembly comprising:

a lock arm mechanism including an actuable lock arm and an actuator;

a lock arm mounting assembly for mounting said lock arm mechanism in the enclosed structure; and a stabilizer capable of providing rigidity to one of the fingers, wherein said actuator is capable of engaging the rigid finger on the locking bar.

2. A lock assembly according to claim 1, wherein said lock arm mechanism includes a pivot pin engaged with said lock arm, and said actuator extends from a first end of said lock arm for engaging the rigid finger.

3. A lock assembly according to claim 2, wherein said lock arm mechanism further includes a lock cam for engaging a second end of said lock arm for pivoting said lock arm about said pivot pin.

4. A lock assembly according to claim 1, wherein said lock arm mounting assembly includes a lock module bracket and cam nuts for securing said lock module bracket to a plurality of flanged support posts.

5. A lock assembly according to claim 1, wherein said lock arm mounting assembly can be secured to a plurality of flanged support posts, and includes a frame, a lock module bracket and a lock face connected together to form a housing for said lock arm.

6. A lock assembly according to claim 1, wherein said lock arm mounting assembly can be secured to a plurality of flanged support posts, and includes a shelf, a lock module bracket, a lock module tray and a lock face connected together to form a housing for said lock arm.

7. A locking structure, comprising:

an enclosed structure including first and second sides having interior corrugated surfaces;

a locking bar having a plurality of flexible fingers, said locking bar housed in said first side such that said fingers extend out of openings in said corrugated surface;

a stabilizer on said locking bar for providing rigidity to a designated one of said fingers; and locking means for engaging said designated finger to raise and lower said locking bar.

8. A locking structure according to claim 7, wherein said locking means includes a pivotable lock arm and an actuator extending from a first end of said lock arm for engaging said designated finger.

9. A locking structure according to claim 8, wherein said locking means further includes a lock arm mounting assembly for mounting said lock arm in said enclosed structure.

10. A locking structure according to claim 9, wherein said lock arm mounting assembly is secured to a plurality of flanged support posts of said enclosed structure, and includes a frame, a lock module bracket and a lock face connected together to form a housing for said lock arm.

11. A lock assembly according to claim 9, wherein said lock arm mounting assembly is secured to a plurality of flanged support posts of said enclosed structure, and includes a shelf, a lock module bracket, a lock module tray and a lock face connected together to form a housing for said lock arm.

12. A locking structure according to claim 8, wherein said locking means further includes a pivot pin engaged with said lock arm and a lock cam for engaging a second end of said lock arm for pivoting said lock arm about said pivot pin.

13. A lock assembly for use with a locking bar having a plurality of flexible fingers, comprising:

stiffening means for rendering a designated finger substantially inflexible in at least one direction; and locking means for engaging said designated finger to raise and lower the locking bar.

14. A lock assembly according to claim 13, wherein said stiffening means includes a rigid member disposable on the lock bar.

15. A locking structure according to claim 13, wherein said locking means includes a pivotable lock arm and an actuator extending from a first end of said lock arm for engaging said designated finger.

16. A locking structure according to claim 15, wherein said locking means further includes a lock arm mounting assembly capable of mounting said lock arm in an enclosed structure.

17. A locking structure according to claim 16, wherein said lock arm mounting assembly is capable of being secured to a plurality of flanged support posts, and includes a frame, a lock module bracket and a lock face connected together to form a housing for said lock arm.

18. A lock assembly according to claim 16, wherein said lock arm mounting assembly is capable of being secured to a plurality of flanged support posts, and includes a shelf, a lock module bracket, a lock module tray and a lock face connected together to form a housing for said lock arm.

19. A locking structure according to claim 15, wherein said locking means further includes a pivot pin engaged with said lock arm and a lock cam for engaging a second end of said lock arm for pivoting said lock arm about said pivot pin.

20. A locking structure, comprising:

an enclosed structure including a plurality of flanged support posts and first and second sides having interior corrugated surfaces;

a locking bar having at least one locking member;

a lock arm mechanism including means for raising said locking bar by engaging said locking member;

a lock arm mounting assembly mounting said lock arm mechanism; and modular mounting means for mounting said lock arm mounting assembly to said flanged support posts.

21. A locking structure according to claim 20, wherein said means for raising said locking bar includes a pivotally mounting lock arm and an actuator extending from one end of said lock arm.

22. A locking structure according to claim 21, wherein said means for raising said locking bar includes a stabilizer for providing rigidity to said one locking member on said locking bar for engagement by said actuator.

23. A locking structure according to claim 20, further comprising a stabilizer to stabilize said locking member on said locking bar.

24. A modular lock assembly for use in an enclosed structure housing a locking bar having a plurality of locking members, said assembly comprising:

a lock arm mechanism including an actuable lock arm;

a lock arm mounting assembly for mounting said lock arm mechanism in the enclosed structure;

modular mounting means for securing said lock arm mounting assembly to the enclosed structure; and locking means for locking the enclosed structure by engaging one of the locking members.

25. A modular lock assembly according to claim 24, wherein said locking means includes an actuator extending from said lock arm and a stabilizer capable of providing rigidity to one of the locking members on the locking bar.

26. A modular lock assembly according to claim 24, wherein said locking means is capable of locking the enclosed structure by engaging a stabilized one of said locking members on the locking bar.

* * * * *

UNITED STATES PATENT AND TRADEMARK OFFICE

CERTIFICATE OF CORRECTION

PATENT NO. : 6,158,830
DATED : December 12, 2000
INVENTOR(S) : Eric C. Johnson et al.

It is certified that error appears in the above-identified patent and that said Letters Patent is hereby corrected as shown below:

Column 6,
Line 65, "bar." should read -- bar in order to raise the locking bar. --.

Signed and Sealed this

First Day of January, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,158,830
DATED : December 12, 2000
INVENTOR(S) : Eric C. Johnson et al.

It is certified that error appears in the above-identified patent and that said Letters Patent is hereby corrected as shown below:

Column 6,
Line 65, "bar." should read -- bar in order to raise the locking bar. --.

Signed and Sealed this

Twenty-ninth Day of January, 2002

*Attest:*

*Attesting Officer*

JAMES E. ROGAN
*Director of the United States Patent and Trademark Office*